US005465901A

United States Patent [19]

Paine, Jr.

[11] Patent Number: 5,465,901

[45] Date of Patent: Nov. 14, 1995

[54] BASKET FOR PRODUCE

[76] Inventor: Derrick Paine, Jr., 3889 Karen Lynn Dr., Glendale, Calif. 91206

[21] Appl. No.: 352,148

[22] Filed: Dec. 1, 1994

[51] Int. Cl.[6] ..... B65D 1/34; B65D 1/38

[52] U.S. Cl. ..... 229/407; 220/4.23; 220/306; 220/339; 220/485; 220/676; 229/120

[58] Field of Search ..... 229/120, 120.1, 229/406, 407; 220/4.22, 4.23, 4.24, 305, 306, 339, 485, 676, 913

[56] References Cited

U.S. PATENT DOCUMENTS

| | | | |
|---|---|---|---|
| 2,839,214 | 6/1958 | Crane | 220/676 |
| 3,633,785 | 1/1972 | Cyr et al. | 220/339 |
| 3,710,901 | 1/1973 | Guard et al. | 220/339 |
| 3,716,164 | 2/1973 | Fennema | 220/306 |
| 3,836,040 | 9/1974 | Paine, Jr. et al. . | |
| 3,900,129 | 8/1975 | Scholz | 220/306 |
| 4,143,805 | 3/1979 | Sutton | 220/4.23 |
| 4,243,140 | 1/1981 | Thrun | 220/339 |
| 4,298,133 | 11/1981 | Davis | 229/406 |
| 4,892,220 | 1/1990 | Foos | 220/306 |
| 4,915,251 | 4/1990 | Payne | 220/306 |
| 5,012,928 | 5/1991 | Proffitt et al. | 220/306 |

*Primary Examiner*—Gary E. Elkins
*Attorney, Agent, or Firm*—William W. Haefliger

[57] ABSTRACT

A plastic openwork receptacle and a plastic openwork cover therefor, the receptacle and cover having plastic hinge interconnection, the receptacle having an upper rectangular ledge, facing upwardly, and the cover having a lower rectangular ledge facing downwardly, in closed connection, the upper and lower ledges sized to register upon closing of the cover over the receptacle. Each of the ledges has two laterally spaced longitudinally elongated first sections, and two longitudinally spaced laterally extending second sections, each first section being about twice the length of each second section. There are four corners formed by intersecting of the first and second sections of each ledge; there are a primary tongue and groove interconnection of the ledges at a first pair of corners formed by the ledges, and a secondary tongue and groove interconnection of the ledges at a second pair of corners formed by the ledges; and there are a tertiary tongue and groove interconnection of the ledges at an elongated location along two of the longitudinally elongated ledge sections, intermediate the first and second pairs of corners.

12 Claims, 3 Drawing Sheets

BASKET FOR PRODUCE

BACKGROUND OF THE INVENTION

This invention relates generally to plastic baskets of the type to receive produce such as berries, tomatoes, and the like; and more particularly it concerns improvements in the construction of such baskets.

In the past, baskets of the above type were formed of thin wood sections, integrated together. More recently, baskets for this purpose were molded of plastic material. There is need for improvements in such plastic molded baskets enhancing lid or cover connection to produce filled receptacles, as well as enabling ready stacking of such baskets in such manner as to assist in such cover connection. There is also need for improved openwork basket and cover configurations, which enable use of less plastic material, while providing for sufficient basket strength as to withstand stacking of multiple loaded baskets, and with stability.

SUMMARY OF THE INVENTION

It is a major object of the invention to provide an improved plastic molded basket construction meeting the above needs. Basically, the improved produce basket of the invention comprises:

a) a plastic openwork receptacle and a plastic openwork cover therefor, the receptacle and cover having plastic hinge interconnection, b) the receptacle having an upper rectangular ledge, facing upwardly, and the cover having a lower rectangular ledge facing downwardly, the upper and lower ledges sized to register upon closing of the cover over the receptacle, each ledge having two laterally spaced longitudinally elongated first sections, and two longitudinally spaced laterally extending second sections, each first section being about twice the length of each second section; there being four corners formed by intersecting of the first and second sections of each ledge, c) there being a primary tongue and groove interconnection of the ledges at a first pair of corners formed by the ledges, and a secondary tongue and groove interconnection of the ledges at a second pair of corners formed by the ledges, d) and there being a tertiary tongue and groove interconnection of the ledges at an elongated location along two of the longitudinally elongated ledge sections, intermediate the first and second pairs of corners.

It is another object to provide such a basket wherein each tongue and groove interconnection includes a groove formed by the upper ledge and a tongue formed by the lower edge, at each of the first and second pairs of corners. Typically, each such groove may extend through an angle of about 90° at and around the associated corner formed by the upper ledge.

Yet another object is to provide the plastic hinge interconnection along, but offset from, a second, i.e. elongated, section of the upper ledge; and that interconnection may also extend along and be offset from a corresponding section of the lower ledge. Those connected ledge sections are thereby molded to flatly engage one another when the cover is closed.

As will be seen, the receptacle typically has openwork side panels and end panels, at least two of such panels including openly spaced webs forming arches having uppermost merging extents adjacent two of the sections of the lower ledge and integral therewith, whereby the objective of substantially maximum strength along with substantially minimum use of plastic material is met. In this regard, two or more such side panels may also include openly spaced webs forming arches having uppermost merging extents proximate another two of the sections of the lower ledge, and integral therewith. As will be seen, web uppermost merging extents of the webs may have gothic arch shape, to promote the stated objectives.

Yet another objective is to provide the cover to have a top substantially horizontal panel for stacking against a horizontal bottom panel of another basket receptacle, the top cover having slanting openwork side panels and end panels extending between the top panel and said upper ledge sections whereby, the multiple interconnections are maintained, during such multiple stacking, the carry volume under the cover being optimized, while upward taper of edge portions of the cover is maintained. Spreading of the cover is prevented since it is captivated between the row of multiple tongue and groove interconnections, and the plastic hinge extending parallel to the row of interconnections.

These and other objects and advantages of the invention, as well as the details of an illustrative embodiment, will be more fully understood from the following specification and drawings, in which:

DRAWING DESCRIPTION

DETAILED DESCRIPTION

Figure 1:
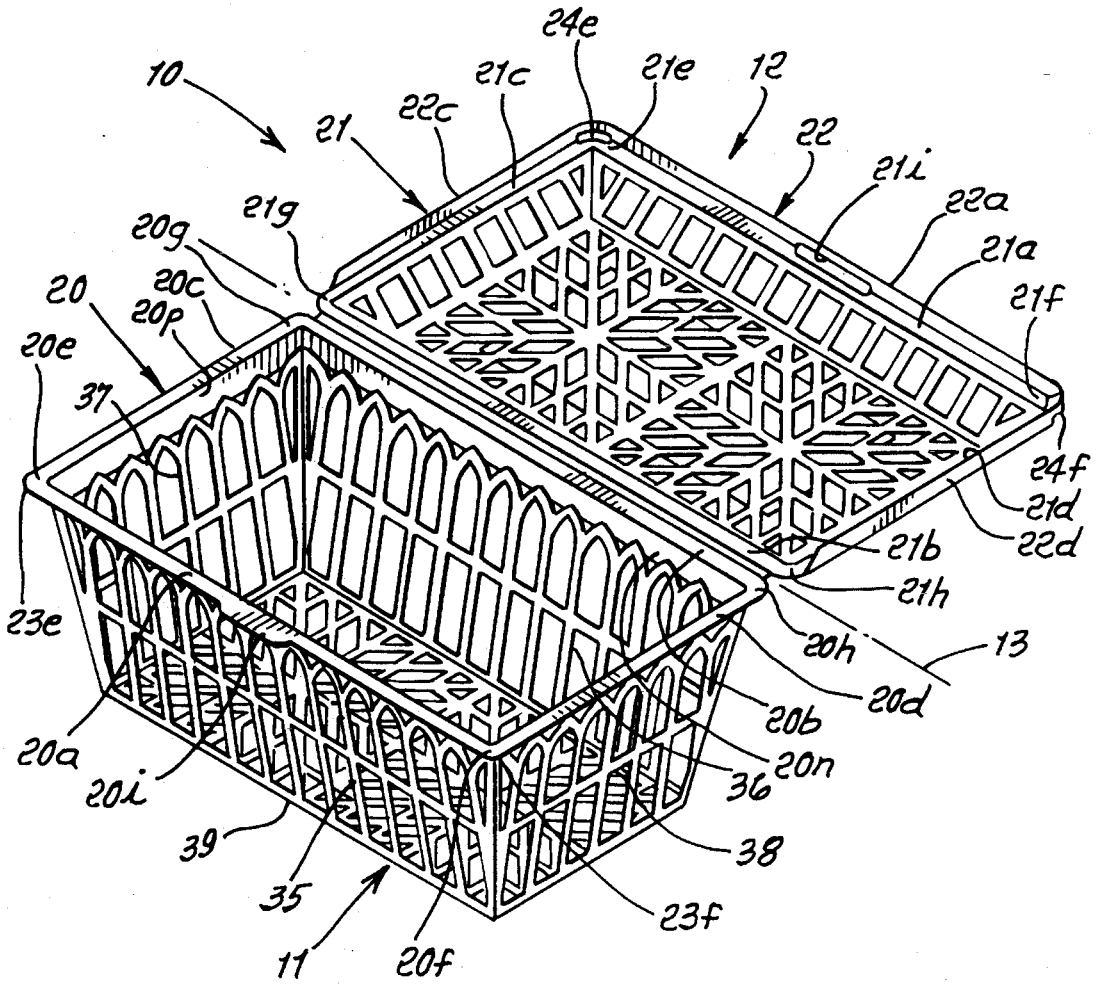
FIG. 1 is a perspective view of an opened up basket incorporating the invention.
Figure 2:
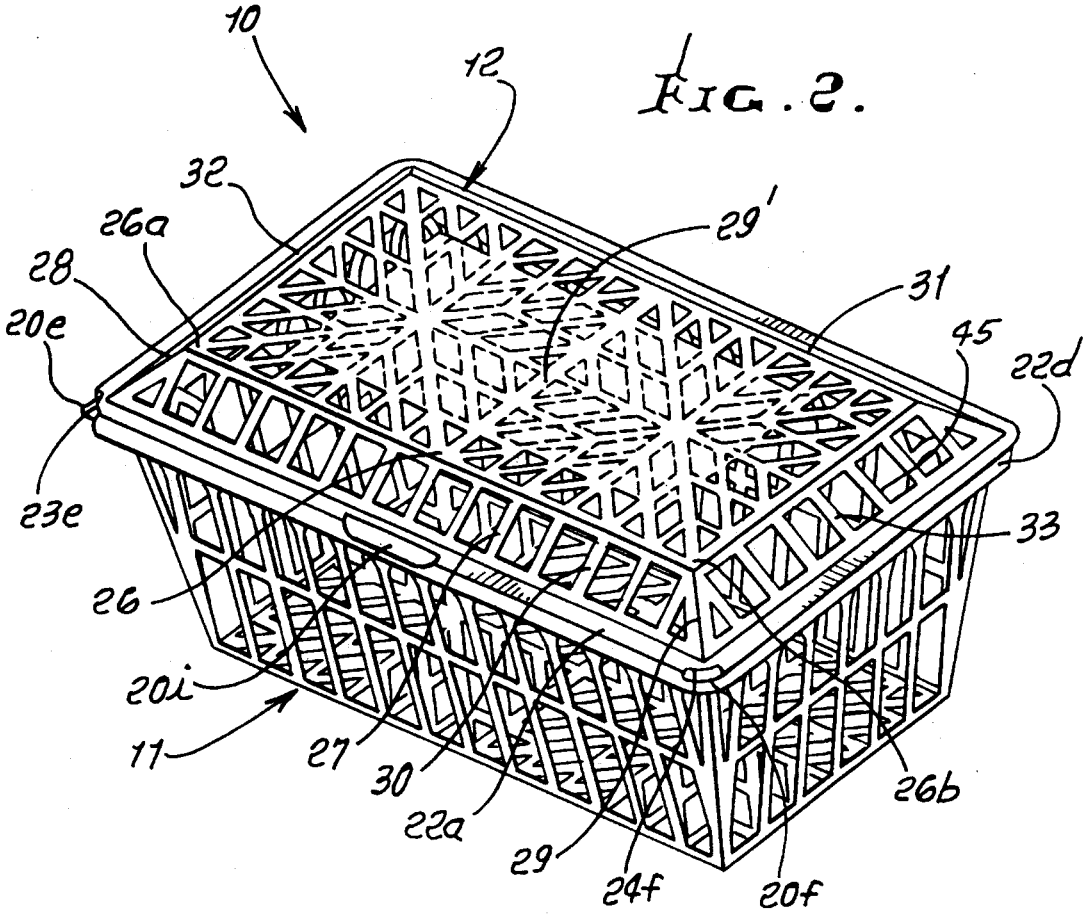
FIG. 2 is a perspective view of the FIG. 1 basket in closed combination.
Figure 5:
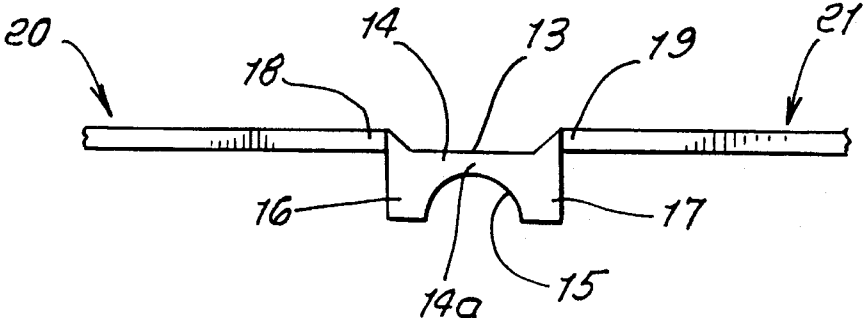
FIG. 5 is an enlarged end view of the basket hinge structure, as related to receptacle and cover ledges.

In the drawings the basket 10 includes a receptacle 11 and a cover 12. The cover in FIG. 1 is shown in open condition, which is rotated approximately 180° from closed condition as seen in FIG. 2 The axis of rotation appears at 13 and is located at an elongated plastic hinge 14 seen in FIG. 5, the hinge being integral with and offset horizontally from receptacle and cover ledges that interengage, as will appear. Note the thinned middle portion **14*a* of the hinge in FIG. 5, above an arch 15 defined by thickened downwardly extending sections 16 and 17 which are laterally offset, and which run longitudinally parallel to axis 13. These sections 16 and 17 stabilize the cover and receptacle along their ledge extents 18 and 19 to be interconnected by the hinge, one objective being to confine plastic folding to the hinge 14 itself rather than at thin ledges 20 and 21 referred to below. Thus, sections 16 and 17 provide a buffer or isolating function as respects plastic material folding upon closing of the cover downward upon the receptacle to the condition seen in FIG. 2**.

The receptacle 11 has an upper rectangular ledge 20 facing upwardly, and the cover 12 has a lower rectangular ledge 21 facing downwardly in closed condition. Also, the upper and lower ledges 20 and 21 are sized to register upon closing of the cover over and upon the receptacle. Ledge 20 has two laterally spaced longitudinally elongated first sections 20*a* and 20*b*, and two longitudinally spaced laterally extending second sections 20*c* and 20*d*, sections 20*a* and 20*b* being typically about twice the length of each second sections 20*c* and 20*d*. Likewise, ledge 21 has two laterally spaced longitudinally elongated first sections 21*a* and 21*b*, and two longitudinally spaced laterally extending sections 21*c* and 21*d*, sections 21*a* and 21*b* being about twice as long as the sections 21*c* and 21*d*. Four corners 20*e*–20*h* are formed by intersections as shown of the ledge sections 20*a*–20*d*, and likewise four corners 21*e*–21*h* are formed by intersections of the cover ledge sections 21*a*–21*d*. A ledge shield 22 is provided on the cover and includes section 22*c* shielding ledge 21*c*, shield section 22*d* shielding ledge section 21*d*, and shield section 22*a* shielding ledge section 21*a*. These shield sections are integral with the cover and loosely overhang downwardly adjacent the receptacle ledge sections 21*a*, 21*c* and 21*d*, thereby to block relative motion of the cover and receptacle, such as would tend to inadvertently disconnect tongue and groove snap interconnections as described below. The elongated buffered hinge structure extends parallel to such multiple tongue and groove interconnections, to also facilitate rapid interconnection and disconnection of such multiple tongue and groove interconnections.

In accordance with a further aspect of the invention a primary tongue and groove interconnection of the receptacle and cover ledges is provided at a first pair of corners, such as 20*e* and 21*e* formed by the ledges; and a secondary tongue and groove interconnection of the receptacle and cover ledges is provided at a second pair of corners, 20*f* and 21*f* formed by the ledges. In addition a tertiary tongue and groove interconnection of the receptacle and cover ledges is provided at an elongated location or locations such as 20*i* and 21*i* along two of the longitudinally elongated ledge sections such as 20*a* and 21*a*, intermediate the first and second pairs of corners as referred to. Thus, the intermediate tongue and groove connection at 20*i* and 21*i*, and the tongue and groove interconnections at the first and second corners as referred to, extend in a row generally parallel to the hinge axis.

As illustrated, each tongue and groove interconnection includes a groove formed by or adjacent the upper ledge and a tongue formed by or adjacent the lower edge, at each of the first and second pairs of corners. For example, referring to FIGS. 1 and 2, corner tongues 23*e* and 23*f* formed by ledge corners 20*e* and 20*f* on the receptacle are receivable into grooves 24*e* and 24*f* formed at the cover ledge corners 21*e* and 21*f*. Such grooves extend arcuately about 90° around such corners thereby to receive the 90° corner tongues 23*e* and 23*f* as shown. At the same time, the connection element in the form of an elongated intermediate slot 21*i* receives the elongated intermediate tongue 20*i* associated with ledge 20*a*. This is facilitated by pressing down on the cover intermediate portion 26 which extends the slanting portion 27 of the cover sidewardly to allow the slot 21*i* to slip over the tongue 20*i* to envelope same. See FIG. 2. Loosening is likewise facilitated by such downward pressing on the cover to disconnect 21*i* from tongue 20*i*, and pressing down at top regions 26*a* and 26*b* thereby allowing the corner tongue and grooves to disengage. Stiffness of the cover, and its angularities as shown facilitates transmitting of loosening forces to the cover corner portions 28 and 29 to effect such disconnection. The push down zone 26 may also extend inwardly to the flat top 29 of the cover, the latter flat also serving to facilitate stacking of produce loaded baskets. The cover has slanting openwork side panels 30, 31, 32 and 33 extending between the top panel 29 and the cover upper ledge sections as shown, the slant angle of each panel being about 45° from horizontal.

Figure 3:
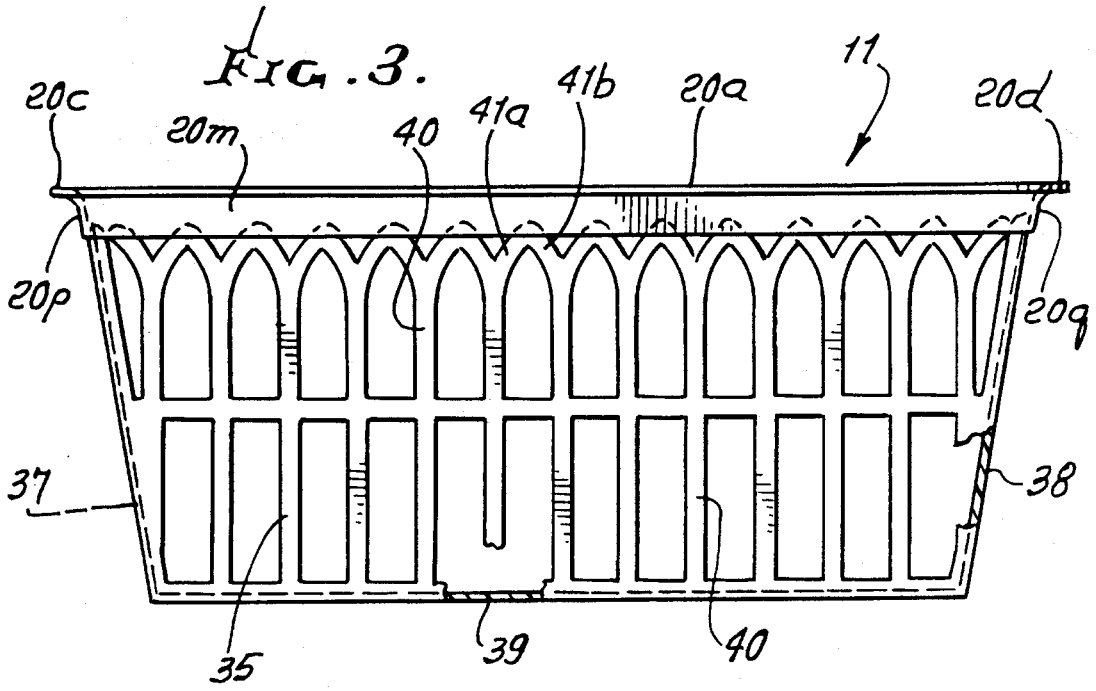
FIG. 3 is an enlarged side elevation view of the basket receptacle.
Figure 4:
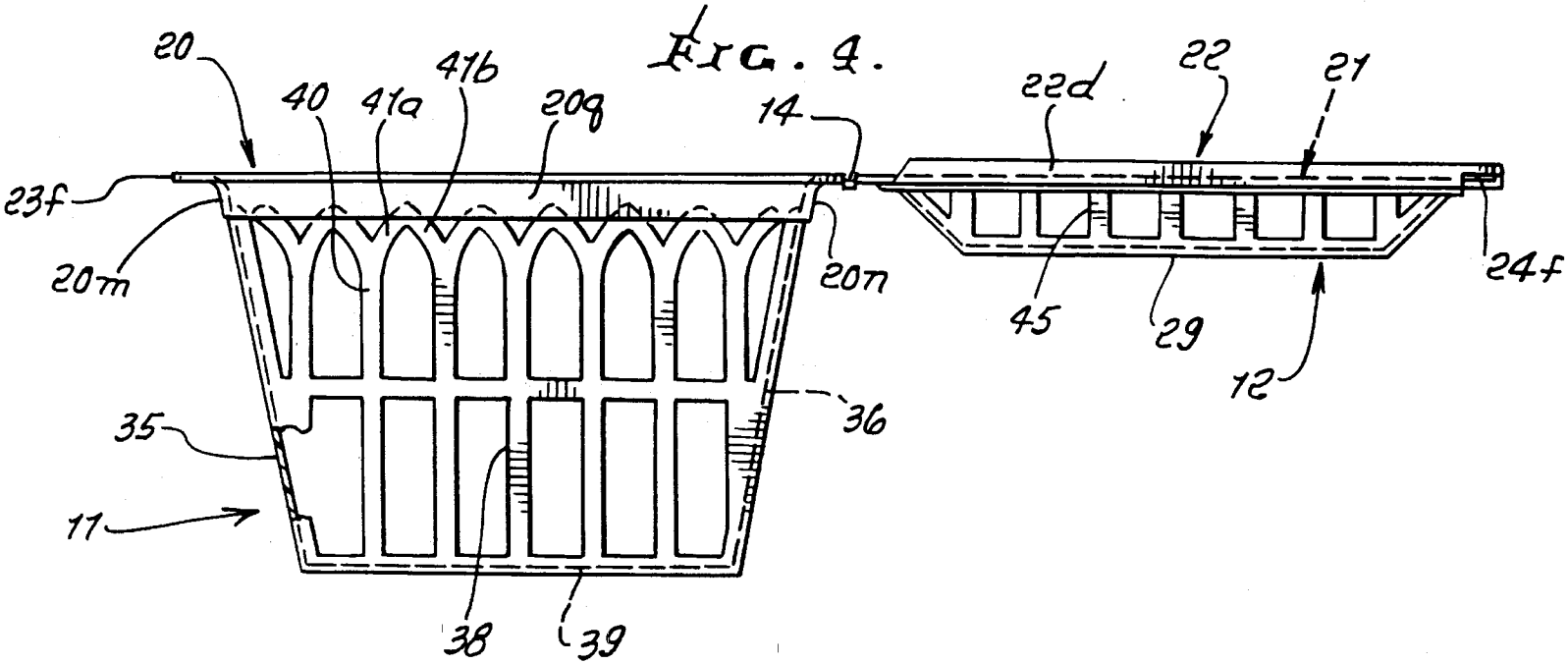
FIG. 4 is an enlarged end elevation view of the basket receptacle, with cover opened up about 180°.

The receptacle also has openwork side panels 35, 36, 37 and 38 extending between the ledge 20 and a bottom flat panel 39 also having openwork construction. Panels 35 and 36 taper relatively downwardly, as do panels 37 and 38. To minimize plastic material requirements while maintaining adequate strength of loaded baskets, the receptacle side and end panels have openly spaced webs as at 40 which extend upwardly and form arches having uppermost merging extents 41*a* and 41*b* seen in FIG. 3. Those merging extents lie adjacent downward extending flanges as at 20*m*, 20*n*, 20*p* and 20*q* associated with the ledge 20 sections as shown, and integral with the inner sides of such downward flanges, providing a very strong structure. This is enhanced by the gothic arch configuration of 41*a* and 41*b* as shown.

Stack loading is transmitted to ledge 21 via slanted webs 45 on the cover, then to ledge 20, then to flanges 20*m*, 20*n*, 20*p*, 20*q*, then to the gothic arch forming webs 41*a* and 41*b*, and thus via upright webs 40 to the receptacle lower panel. Only one row of horizontal connector web 45 is needed to connect webs 40, intermediate their upper and lower ends.

I claim:

1. A produce basket, comprising:

a) a plastic openwork receptacle and a plastic openwork cover therefor, said receptacle and cover having plastic hinge interconnection, b) said receptacle having an upper rectangular ledge, facing upwardly, and said cover having a lower rectangular ledge facing downwardly, in closed connection, said upper and lower ledges sized to register upon closing of the cover over the receptacle, each ledge having two laterally spaced longitudinally elongated first sections, and two longitudinally spaced laterally extending second sections, each first section being about twice the length of each second section; there being four corners formed by intersecting of said first and second sections of each ledge, c) there being a primary tongue and groove interconnection of said ledges at a first pair of said corners formed by said ledges, and a secondary tongue and groove interconnection of said ledges at a second pair of said corners formed by said ledges, d) and there being a tertiary tongue and groove interconnection of said ledges at an elongated location along two of said longitudinally elongated ledge sections, intermediate said first and second pairs of corners.

2. The basket of claim 1 wherein each tongue and groove interconnection includes a groove formed by the upper ledge and a tongue formed by the lower edge, at each of said first and second pairs of corners.

3. The basket of claim 2 wherein each said groove extends through an angle of about 90° at and around the associated corner formed by the upper ledge.

4. The basket of claim 1 wherein said plastic hinge interconnection is located along but offset from one of said second sections of the upper ledge.

5. The basket of claim 4 wherein said plastic hinge interconnection is also located along and offset from one of said second sections of the lower ledge.

6. The basket of claim 1 wherein the receptacle has openwork side panels and end panels, at least two of said panels including openly spaced webs forming arches having uppermost merging extents adjacent two of the sections of the lower ledge and integral therewith.

7. The basket of claim 6 wherein at least two more of said panels also includes openly spaced webs forming arches having uppermost merging extents adjacent another two of the sections of the lower ledge, and integral therewith.

8. The basket of claim 6 wherein said web uppermost merging extents have gothic arch shape.

9. The basket of claim 7 wherein said web uppermost merging extents adjacent said another two of the sections of the lower ledge also have gothic shape.

10. The basket of claim 1 wherein the cover has a top panel, and slanting openwork side panels and end panels extending between the top panel and said upper ledge sections.

11. The basket of claim 6 including flanges integral with said lower ledge, and relative to which the lower ledge projects outwardly, said arch merging extents being integral with said flanges.

12. The basket of claim 5 including buffer means located between said plastic hinge interconnection and said second sections of the upper and lower ledges.

* * * * *